United States Patent [19]

Draus

[11] Patent Number: 4,964,807

[45] Date of Patent: Oct. 23, 1990

[54] ELECTRICAL CONNECTOR AND DUAL PURPOSE TEST JACK

[76] Inventor: Thomas A. Draus, 2 Tabor Rd., Enfield, Conn. 06082

[21] Appl. No.: 432,152

[22] Filed: Nov. 6, 1989

[51] Int. Cl.[5] ..... H01R 11/24

[52] U.S. Cl. ..... 439/169; 439/801; 439/825; 439/829

[58] Field of Search ..... 439/169, 805, 822, 825, 439/826, 827, 829, 834, 801; 219/138–141

[56] References Cited

U.S. PATENT DOCUMENTS

| | | | |
|---|---|---|---|
| 1,418,468 | 6/1922 | Raus | 439/805 |
| 1,583,697 | 5/1926 | Latham | 439/805 |
| 1,935,061 | 11/1933 | Richards | 439/825 |
| 1,965,151 | 7/1934 | Mueller | 439/829 |
| 4,736,480 | 4/1988 | Bohl et al. | 439/829 |

FOREIGN PATENT DOCUMENTS

| | | | |
|---|---|---|---|
| 876663 | 11/1942 | France . | |
| 488237 | 2/1955 | Italy | 439/825 |
| 708468 | 5/1954 | United Kingdom . | |

*Primary Examiner*—Neil Abrams
*Attorney, Agent, or Firm*—Chapin, Neal & Dempsey

[57] ABSTRACT

An electrical connector and dual purposes test jack used for testing electrical devices includes both a spring clamp member and a "plug in" pin assembly. The pin assembly has, at one end, an electrically conductive wire receiving portion, a setscrew for attaching an electrical wire thereto, an insulator sleeve therearound and, at the opposite end, a cylindrical, radially compressible, bifurcated, conductive pin having an externally threaded inner end portion. The spring clamp member has, at one end, an electrically conductive tubular receptacle internally threaded adjacent the end thereof and, and its other end, a conductive spring clamp. The pin is longitudinally bifurcated at its outer end portion and is dimensioned such that it may be axially inserted past the internal threads of the receptacle and securely held therein place by the radial compression thereof. For a more secure connection, after axial insertion into the receptacle, the pin may also be screw-fitted within the receptacle by rotating a small number of turns.

6 Claims, 1 Drawing Sheet

ELECTRICAL CONNECTOR AND DUAL PURPOSE TEST JACK

BACKGROUND OF THE INVENTION

This invention relates to multi-purpose electrical test jacks and, more particuarly, to such test jacks which include a partially threaded, terminal pin and a spring clamp, connected to a tubular receptacle adapted first to removably receive the pin therein by axial insertion and for greater security of the connection by optionally screw-fitting together the partially threaded pin and receptacle.

Various types of electrical connectors have been developed in the past, such as Heckman U.S. Pat. No. 1,761,728 which shows a fully threaded pin and receptacle connector. This is a very secure but cumbersome type of connection where the pin must be fully screwed into or unscrewed from the receptacle. A less cumbersome but also secure connection is shown in Jackson U.S. Pat. No. 2,375,656 where a pin may be longitudinally inserted into a sleeve or housing and snapped together. The drawback to this type of connector is that once the connection is made, it cannot simply be unsnapped and pulled apart, but a locking element 58 must first be uncoupled. A more recent development is the "plug in" jack type of electrical connector which may be both connected and disconnected by simply longitudinally inserting the pin into or removing the pin from the sleeve or housing, such as shown in Bohl et al U.S. Pat. No. 4,736,480 ; Sihn British Pat. No. 708,468 and Paufler French Pat. No. 876,663. While it is generally desirable, when working with electrical test equipment, to have a quick and easy connection, as these patents show, it is also important to have a more secure connection. But, none of these patents show an effective means for securing the "plug in" connection so that it will not readily pull apart in normal usage.

Accordingly, it is the principal object of this invention to provide a multi-purpose jack assembly with a "plug-in" terminal pin that can simply be axially inserted into a receptacle connected to a clamping device for making quick electrical connections and in which the "plug-in" connection may optionally be secured by screw-fitting the axially coupled parts together.

The above and other objects and advantages of this invention will be more readily apparent from the following description read in conjunction with the accompanying drawings, in which.

DETAILED DESCRIPTION OF THE INVENTION

Figure 1:
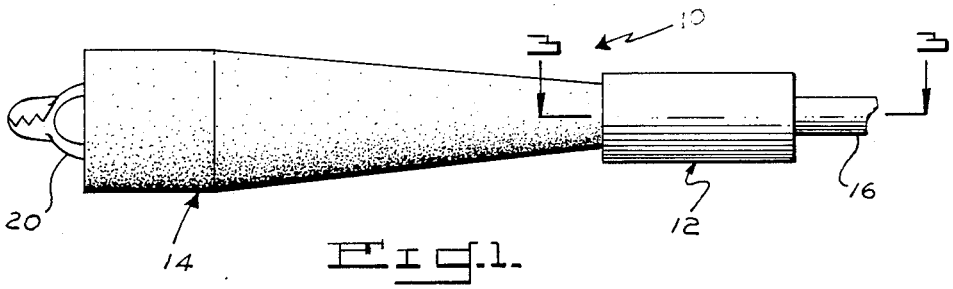
FIG. 1 is an elevational view showing a multipurpose electrical test jack of the type embodying this invention.
Figure 4:
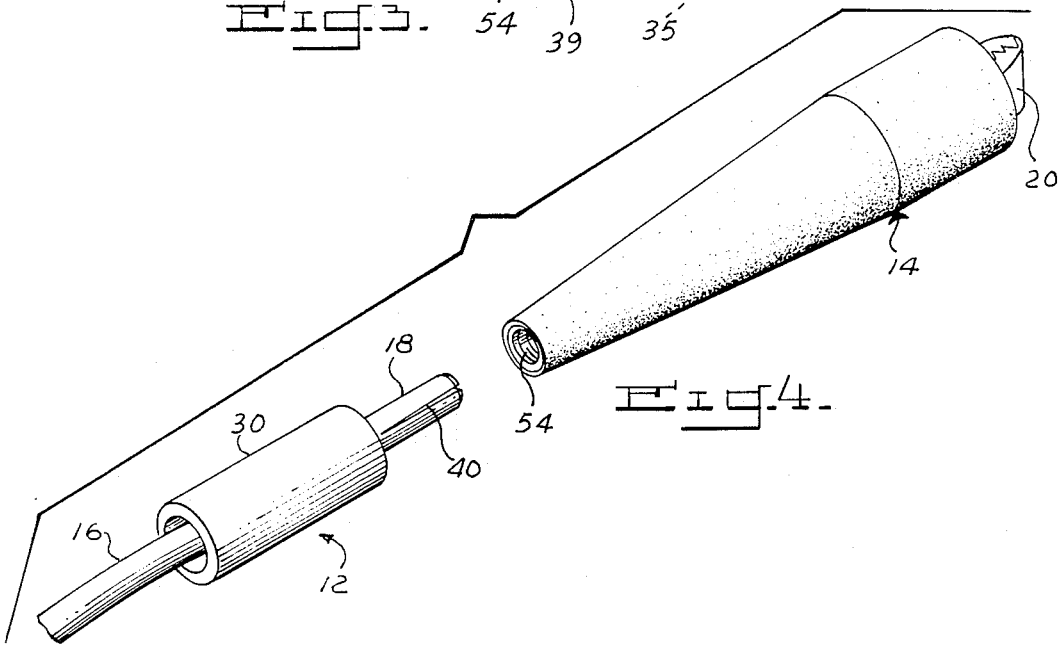
FIG. 4 is a perspective view of the test jack showing portions thereof disconnected.

The multi-purpose test jack 10 embodying this invention is shown in FIG. 1 in assembled condition and, in FIG. 4, separated into its two principal components, that is, a terminal pin connector 12 and sheathed spring clamping connector 14. An electrically conductive wire 16 adapted to be connected to a test meter (not shown), to a metallic terminal pin 18 and a metallic spring clamp 20 so that one or both may be used to connect to sockets or studs for electrical testing purposes.

Figure 2:
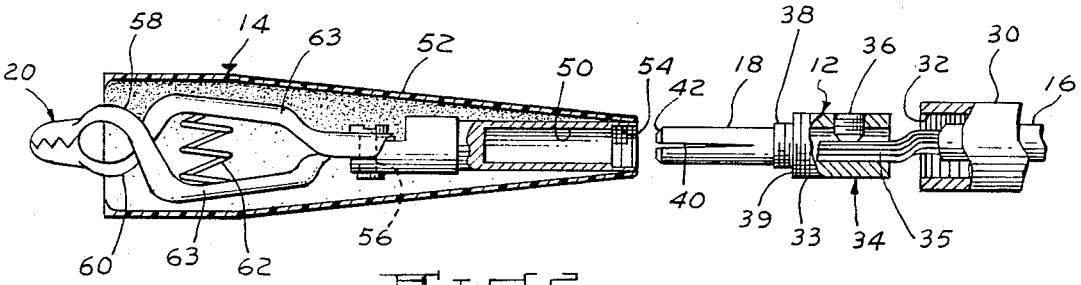
FIG. 2 is a cross-sectional, elevational view of the test jack of FIG. 1, but with the parts in different operative positions.
Figure 3:
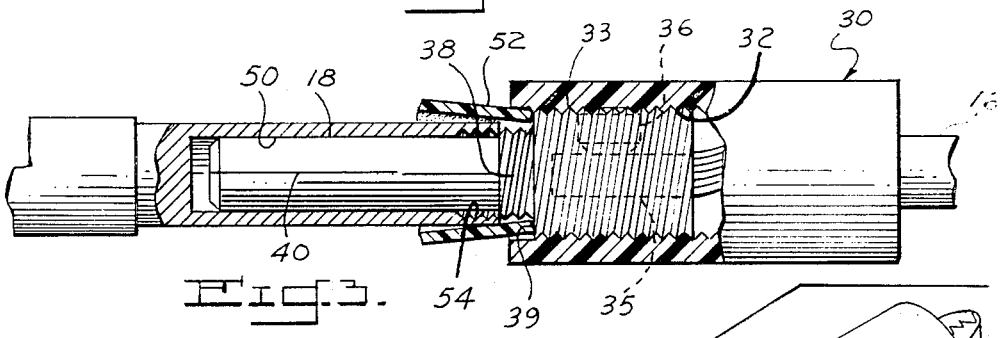
FIG. 3 is a cross-sectional view, on an enlarged scale, taken along line 3—3 of FIG. 1.

As depicted in FIG. 2, the terminal pin connector 12 comprises the pin 18 and a tubular sleeve 30 of insulating material, such as a rigid ceramic or the like, threaded internally, as at 32. At one end of the pin 18 is an electrically conductive, cylindrical wire retaining member 34, externally threaded, as at 33, to screw-fit completely into the internally threaded sleeve 30 with its "closed" end recessed inwardly of sleeve 30, as shown in FIG. 3. The retaining member 34 is "open" in the direction opposite pin 18 to recieve therein the bared end 35 of the conductor wire 16 which is securely fastened within the member 34 by a radially extending setscrew 36. The shank portion of electrically conductive pin 18 extends from the "closed" end of member 34 and is threaded, as at 38, for a few turns adjacent shoulder 39. The remainder of pin 18 is not threaded and is longitudinally bifurcated by axially extending slot 40 and its outer end is chamfered, as at 42.

The diameter of pin 18 is such that it will have an interference fit within metallic receptacle or socket 50 disposed within the flexible sheath 52. The pin and wire retaining member 34 is preferably fabricated of a metallic electrically conductive material which has sufficient resilience such that its bifurcated end portion 40 will be compressed radially when inserted into socket 50 despite internal screw threads 54 at its outer end portion.

The clamping connector 14 comprises the conductive metallic receptacle socket 50 connected to conductive spring clamp 20 by means of screw connector 56, all disposed within the rubber or elastomeric sheath 52. The sheath is at both ends and tapered in cross-section from its larger end surrounding clamp 20 to its smaller end around the outer end of socket 50. The clamp 20 includes two serrated jaw portions 58 and 60 urged together by coil spring 62 disposed between spaced opposed arm portions 63. The sheath is sufficiently flexible so that the clamp may be operated externally thereof by pressing together the arm portions 63.

Electrical connection is made between the terminal pin 18 and socket or receptacle 50 of clamp connector 14, as seen in FIG. 3, by longitudinally inserting the bifurcated portion 40 of pin 18 into receptacle 50 until the outer end of threaded portion 38 contacts the outer end of internal threads 54 of the socket 50. During such insertion, the bifurcated pin will be radially compressed by threads 54 and by the inner diameter of socket 50 and upon complete axial coupling, the free end of the insulator sleeve 30 will butt against flexible sheath 52 to provide electrical insulation about the connection. The pin 18 may thus be readily inserted and withdrawn from socket 50 by quick and easy longitudinal coupling. For a more secure connection, however, the pin 18 may also be screwfitted into the receptacle 50 by rotating connector 12 until all the screw threads 38 at the base of pin 18 mesh with the screw threads 54 in socket 50.

The length of threaded section 38 is preferably about 1/8 inch so that only a few turns are needed to screw the parts together such as when the testing task to be performed does not require use of the pin 18, but only the clamp 20. Moreover, when fully threaded within receptacle or socket 50, the insulated end of sleeve 30 and smaller end of sheath 52 will telescopically fit together, as shown in FIG. 3, to provide a fully insulation connection. To uncouple the, two components, the reverse procedure will be used. Sleeve 30 will be rotated about three or four turns to unscrew the threaded portion 38 of pin 18 from threads 54 and the pin 18 may be axially withdrawn from socket 50. Where the job at hand, such as in testing with A-base or B-base meters, requires use of only the test pin or both a test pin and clamp connector intermittently, the test jack will be used without screw-fitting the two separate components securely together.

Having thus described my invention, what is claimed is:

1. Electrical connector and dual purpose test jack having a clamping member for connecting to a terminal post and a separable pin terminal assembly for "plug in" socket testing and adapted to be connected to a test meter comprising a cylindrical receptacle connected to the clamping member and including an internally threaded portion, said pin terminal assembly including a cylindrical pin, dimensioned for longitudinal insertion with an interference fit within said receptacle including the threaded portion thereof.

2. Electrical connector and dual purpose test jack, as set forth in claim 1, wherein said pin includes an axially split, bifurcated, outer end portion and a threaded inner end portion adapted to mesh with the threaded portion of the receptacle for optionally screw fastening together the pin assembly and receptacle, the bifurcated portion of said pin being radially compressible for interference fit within said receptacle.

3. Electrical connector and dual purpose test jack, as set forth in claim 2, wherein said pin terminal assembly comprises a wire receiving socket at the base of said pin, the free end portion of said pin being bifurcated and the threaded section being disposed at the base portion thereof.

4. Electrical connector and dual purpose test jack, as set forth in claim 3, wherein said pin terminal assembly further comprises a rigid insulator sleeve disposed about the wire receiving socket and in which said clamping member and receptacle are enclosed in an elastomeric sheath of flexible electrical insulation to enable operation of the clamping member with the sheath in place thereabout.

5. Electrical connector and dual purpose test jack, as set forth in claim 4, wherein said wire receiving socket includes a radially extending setscrew for securing therein a bared end of a conductor wire, said socket being externally threaded, said sleeve being internally threaded for receiving therein said socket in screw-fitting engagement.

6. Electrical connector and dual purpose test jack, as set forth in claim 5, wherein said sheath includes an end portion of outer diameter less than the inner diameter of the rigid insulator to enable insulation to fit about the connection between said receptacle and terminal pin.

* * * * *